US012117170B2

(12) United States Patent
Sutherland et al.

(10) Patent No.: US 12,117,170 B2
(45) Date of Patent: Oct. 15, 2024

(54) GAS INCINERATOR SYSTEM

(71) Applicant: Questor Technology Inc., Calgary (CA)

(72) Inventors: John Joseph Sutherland, Calgary (CA); Audrey Mascarenhas, Calgary (CA)

( * ) Notice: Subject to any disclaimer, the term of this patent is extended or adjusted under 35 U.S.C. 154(b) by 203 days.

(21) Appl. No.: 17/436,806

(22) PCT Filed: Aug. 12, 2019

(86) PCT No.: PCT/CA2019/051103

§ 371 (c)(1),
(2) Date: Sep. 7, 2021

(87) PCT Pub. No.: WO2020/176963

PCT Pub. Date: Sep. 10, 2020

(65) Prior Publication Data

US 2022/0170633 A1 Jun. 2, 2022

Related U.S. Application Data

(60) Provisional application No. 62/814,116, filed on Mar. 5, 2019.

(51) Int. Cl.

| | |
|---|---|
| ***F23G 5/32*** | (2006.01) |
| ***F23C 5/32*** | (2006.01) |
| ***F23G 7/06*** | (2006.01) |

(52) U.S. Cl.

CPC ..... *F23G 5/32* (2013.01); *F23C 5/32* (2013.01); *F23G 7/06* (2013.01); *F23G 2200/00* (2013.01)

(58) Field of Classification Search

CPC ..... F23C 5/32; F23G 5/32

See application file for complete search history.

(56) References Cited

U.S. PATENT DOCUMENTS

| | | | | |
|---|---|---|---|---|
| 4,070,146 | A * | 1/1978 | Straitz, III | F23G 7/08 239/521 |
| 4,867,676 | A * | 9/1989 | Buzetzki | F23G 5/008 432/247 |
| 6,168,422 | B1 * | 1/2001 | Motyka | F23G 7/085 431/5 |
| 2005/0126453 | A1 * | 6/2005 | Uchida | F23G 5/32 110/297 |
| 2018/0119950 | A1 * | 5/2018 | Martin | F23D 14/20 |

OTHER PUBLICATIONS

Patent Cooperation Treaty, Written Opinion and International Search Report PCT/CA2019/051103, International Filing Date Aug. 12, 2019, Published Nov. 13, 2019, pp. 1-7, WIPO.

* cited by examiner

*Primary Examiner* — David J Laux

(57) ABSTRACT

An incinerator comprising a cylindrical housing and a plurality of burners is provided. Each burner is oriented to emit gas at an upward and radially inward angle such that the burners collectively generate an upward, helical gas flow. A method for incinerating gas in a cylindrical housing is provided. Flowing gas through a first burner, oriented at an angle, generates an upward, helical gas flow within the cylindrical housing and draws a gas flow through a second burner.

16 Claims, 5 Drawing Sheets

GAS INCINERATOR SYSTEM

FIELD

The invention relates to incinerators, also known as combustors, thermal oxidizers and emissions control devices.

BACKGROUND

The demand for managing environmental emissions, from all industries, continues to grow. Incinerators, also known as combustors, thermal oxidizers and emissions control devices are employed to address emissions by combustion thereof.

There are expectations for high performance, reliability, longevity and flexibility within incinerator designs in order to accommodate a wide range of waste streams. Waste streams vary significantly in composition and key parameters, such as composition, flow rate and pressure.

The combustion, or oxidation at elevated temperatures, of hydrocarbons requires oxygen. Air is introduced in a variety of ways to allow the combustion process to have access to the oxygen that is present within the air.

Often, air is forced into an incinerator by an air mover such as a compressor or blower. While these forced air methods have proven successful, they do require equipment and electrical energy to power the air mover equipment.

SUMMARY

This invention addresses the industry expectations by introducing an incinerator that utilizes the burner arrangement and pressure of the gas or vapor flowing through it to enhance combustion performance while eliminating the need for air movers such as auxiliary blower equipment.

In accordance with a broad aspect of the present invention, there is provided an incinerator comprising: a cylindrical housing extending generally vertically and defining an air intake section, a combustion section above the air intake section, a stack section above the combustion section, a center axis extending through the air intake section and the stack section and a horizontal plane orthogonal to the center axis; and a burner assembly in the combustion section, the burner assembly including a plurality of burners, wherein each of the plurality of burners is oriented to emit gas (i) at an upward angle greater than horizontal and less than vertical and (ii) between a tangential and a radially inward direction, such that the plurality of burners in the burner assembly collectively emit an upward, helical gas flow.

In accordance with another broad aspect of the present invention, there is provided incinerator comprising: a cylindrical housing extending generally vertically and defining an air intake section, a combustion section above the air intake section, a stack section above the combustion section, a center axis defined as extending through the air intake section and the stack section and a horizontal plane orthogonal to the center axis; a first burner assembly in the combustion section, the first burner assembly including a plurality of first burners on a first manifold connected to a first intake pipe, wherein each of the plurality of first burners has a gas emitting orifice with an axis oriented (i) at an upward angle of between 30° and 55° from an orthogonal plane of the incinerator and (ii) at a sideways angle of between 45° and 70° from a radius of the cylindrical housing, such that the plurality of first burners in the first burner assembly collectively generate an upward, helical gas flow; and a dependent burner assembly in the combustion section, the dependent burner assembly including a plurality of dependent burners on a second manifold connected to a second intake pipe, the plurality of dependent burners being positioned radially inward of the plurality of first burners and the plurality of dependent burners being oriented to emit gas upwardly away from the horizontal plane towards the stack section at an angle of between 30° and 55° from an orthogonal plane of the incinerator; and sideways at an angle of between 45° and 70° from a radius of the cylindrical housing.

A method for incinerating gas comprising: providing a cylindrical housing, and a first burner assembly and a dependent burner assembly within the cylindrical housing, the first burner assembly including a first burner oriented at an upward angle from an orthogonal plane of the cylindrical housing and at a sideways angle from a radius of the cylindrical housing; and flowing gas through the first burner assembly, thereby generating an upward, helical gas flow within the cylindrical housing, and drawing a gas flow through the dependent burner assembly It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention.

BRIEF DESCRIPTION OF THE DRAWINGS

The following Figures are included to facilitate understanding.

(a)

(b)

(c)

(d)

(e)

(f)

(g)

(h)

DETAILED DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Throughout this document the words "gas", "hydrocarbon gas", "waste gas", "fuel", "waste stream" and "vapor" are considered interchangeable. Similarly, the terms "incinerator", "combustor", "thermal oxidizer", "emissions control device" and "cylindrical combustion device" may be used interchangeably.

Figure 1:
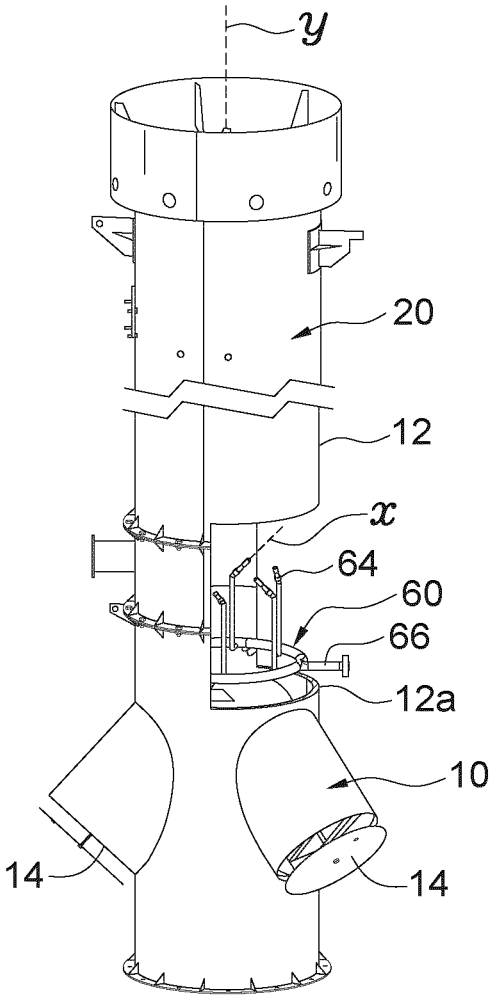
FIG. 1: Components of an incinerator according to one possible embodiment of the invention, wherein a side is cut away to facilitate illustration of internal components.

The primary elements of an incinerator according to an aspect of the invention are shown in FIG. 1. The incinerator housing 12 is comprised of:

(a) Air intake section 10, the air intake section being a lower part of the housing and including ports 14 through the housing wall 12*a* through which air can enter the housing interior;

(b) Combustion section 16 including therein a high pressure burner system 60 (incinerator housing wall cut away), combustion section 16 being above section 10 within housing 12; and (c) Stack section 20 above all burners in system 60 to complete mixing, combustion/oxidation.

The incinerator has a centre axis y that passes through air intake section 10, stack section 20, and system 60.

After extensive research, the present incinerator was invented to eliminate the need for auxiliary air mover equipment, such as a fan or a compressor, while providing good combustion efficiency and incinerator durability. The incinerator utilizes a burner setup along with the pressure of a gas stream introduced to the incinerator to achieve an optimal outcome including:

(a) High mixing above the burner tips;

(b) High negative pressure below the burners to generate a natural draft effect for air induction without an air mover; and (c) Avoids flame impingement on the interior wall of the incinerator.

A high gas pressure offers a stored or potential energy and, when introduced to the incinerator in a unique manner, results in natural air induction, in sufficiency, to efficiently combust or oxidize a broad range of gas streams.

The primary objective was to ensure that sufficient air is able to enter the combustion zone to produce near-complete combustion. Mixing of combustion air and hydrocarbon gas enhances combustion efficiency and the incinerator promotes this.

After considering a large number of waste gas sources and the conditions under which they would enter a stack to be combusted or oxidized, it was decided that high pressure gas streams that worked best in the incinerator to achieve good combustion were those supplied to the stack at greater than 4 psi and particularly greater than or equal to about 5 psi (34.5 kPa) measured as gauge pressure.

The incinerator's high-pressure burner works with the high pressure gas flow to create a negative pressure below the burner and significant mixing above the burner. Negative pressure is directly responsible for inducing air into the stack through the air intake section. The induced air then is effectively mixed with the gas by operation of the burner and results in high combustion efficiency. The magnitude of mixing and negative pressure is independent of gas composition. The burner assembly provides a balance between negative pressure below the burners and mixing above the burners. The high-pressure (HP) burner assembly is capable of high performance operation on its own and also with other burners, if any, in the incinerator.

The HP burner assembly generally operates with a fuel supply at a pressure equal to or greater than about 5 psig (34.5 kPag). The HP burner assembly can be installed in any vertical, cylindrical incinerator housing.

The HP burner assembly includes a plurality of burners oriented to maximize the benefits of the pressure in the HP gas being introduced to the incinerator therethrough. For a cylindrical incinerator stack, the burner assembly includes a plurality of burners. The burners are positioned on the burner assembly spaced apart and substantially symmetrically arranged in a circle. The burner assembly is positioned in the incinerator stack such that the burners' circular arrangement follows, for example is concentric with, the internal perimeter, defined by the inner cylindrical wall, of the cylindrical stack.

Figure 2:
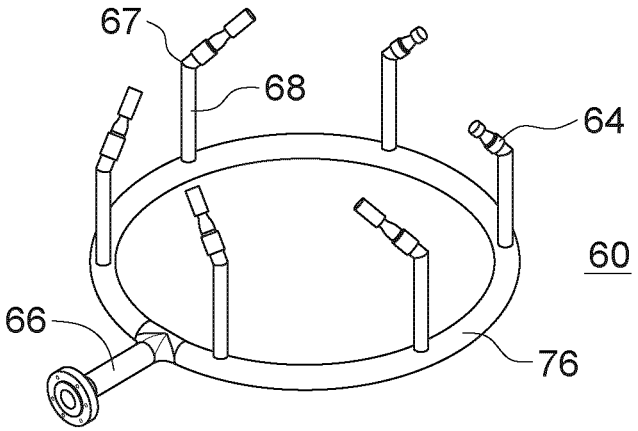
FIG. 2: Oblique view of a manifold with a plurality of high pressure (HP) burners according to one possible embodiment of the invention.

In one embodiment, illustrated in FIG. 2, the burner assembly 60 includes six burners 64, but other numbers of burners can be used. The six burners are spaced apart and positioned in a circle. In one embodiment, the burner assembly includes a manifold 76 on which the burners are connected and from which their orifices receive a supply of gas. The manifold may be at least semi or fully circular and the burners are coupled thereto and obtain their circular positioning as a result of the circular manifold. The burners may be positioned in a substantially symmetrical pattern on the circular manifold, and as such the burner assembly is configured for installation in a cylindrical incinerator housing 12.

The manifold may be installed within the incinerator wall to avoid problems with freeze up. Thus, the circular pipe forming the manifold may be entirely within the incinerator wall. A supply pipe 66 penetrates the incinerator wall to convey gas to the manifold.

Figure 3:
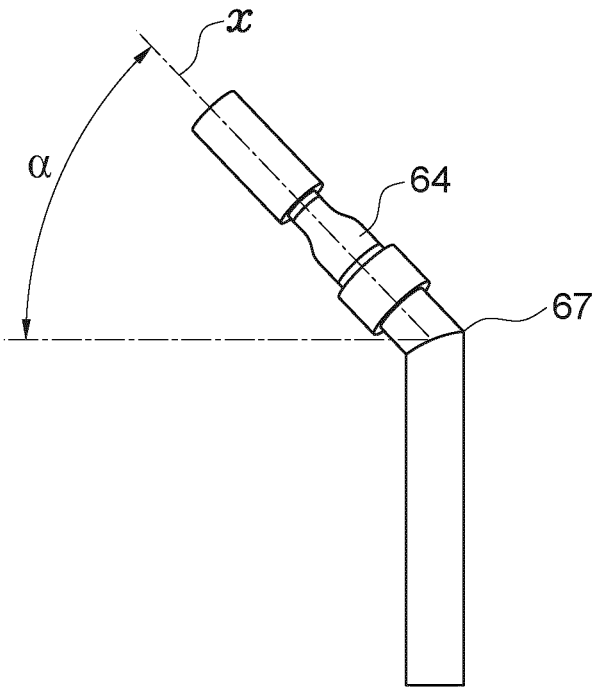
FIG. 3: Side view of an HP burner indicating angle $\alpha$.
Figure 4:
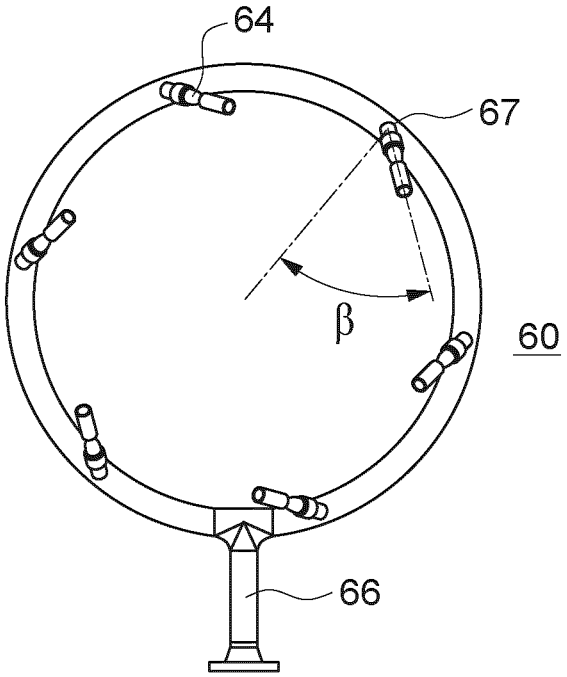
FIG. 4: Top view of a manifold indicating angle $\beta$.

Burners 64 may be installed on conduit fittings 68 that extend up parallel with a center axis orthogonal to the circular body of the manifold. As such, the burners are elevated by the fittings above the manifold. The point at or near where the burners meet the conduit fittings may define a bend 67. Bends 76 may allow burners 64 to emit gas at angles, for example angles $\alpha$ and $\beta$, as illustrated in FIGS. 3 and 4 and described hereinafter.

The burners may be inwardly spaced from the incinerator inner wall.

Each burner includes a body 50 and an orifice 52*a* therein through which gas moves through the burner. Each orifice has an orifice outlet 52*b* at an outboard end where the gas is emitted as a stream G. The stream of gas emitted from the burner is along a line aligned with the long axis x of the orifice at the outlet. In the illustrated embodiment, a burner is used that has an orifice outlet with a long axis concentric to the burner's elongate body and the outlet of the orifice is at an outboard tip of the body. In other words each burner has a body that is elongate with a length and a long axis passing through the burner tip. The gas orifice of each body extends along at least a portion of the length of the body and has an outlet at the tip of the body, which extends along an orifice axis x, which in this embodiment is parallel to, or substantially coincident with, the long axis of the burner. The stream of gas emitted by the burner is inline with the orifice axis at the orifice outlet, which in this embodiment is inline with the long axis of the burner body. Thus, the path of the emitted high pressure gas stream can be selected by appropriate positioning of the tip of each burner.

In the burner assembly, the burners are oriented to emit gas such that the total gas emitted is directed upwardly in the incinerator and collectively generates a helical, which may alternately be called spiral, gas flow. This is an important distinction from prior burner designs where emitted gas flows are directed downwardly into the flow of air, for example, opposite to the upward flow of air, directly vertically upward or directly horizontally planar. In other words, an incinerator as shown in FIG. 1 has a center axis y of the cylindrical housing 12 that is oriented generally vertically and extends from the air intake section and up through the stack section. A horizontal plane of the incinerator can be defined as orthogonal to the center axis, which is illustrated along the circumferential wall 12*a* cutaway shown in FIG. 1. In this incinerator, the burners are oriented to emit gas at an upward angle greater than horizontal and less than vertical, for example, the gas is emitted upwardly from the burners away from the horizontal plane towards the upper end but not exactly parallel to the center axis. In one embodiment, the gas is emitted upwardly toward the stack section and at an angle of between 30° and 55°, or possibly 37 to 47°, from horizontal.

Further, the burner assembly collectively generates a helical gas flow. In this incinerator, burners 64 are oriented to emit gas sideways, in a direction away from the center axis of their circular arrangement which is substantially coincident with the center axis y of the incinerator and all in the same direction (i.e. either in a clockwise or a counter-clockwise direction). In particular, the sideways direction is somewhere between a tangential and a radially inward direction relative to the cylindrical inner wall of the incinerator. Thus, the gas emitted from the burners assumes a sideways rather than directly radially inward flow. In one embodiment, the gas is emitted closer to tangential than to radial such as between 45° and 70° from the radial line between the incinerator's center axis to the cylinder wall. Considering, as well, the upward direction noted above, the emitted high pressure gas flow assumes an upwardly directed helical pattern, which results in effective air induction and gas and air mixing.

In order to achieve these above-noted gas flows, it is important to recognize that each gas composition at a given pressure will exit a burner tip with flow direction dictated by the orientation of the orifice outlet 52*b* at the burner tip. Thus, the burner orientations, and specifically the orifice outlet orientations, dictate the resulting direction of the emitted gas. In the burner assembly, therefore, the burners are oriented to generate the desired flow directions.

FIGS. 3 and 4 illustrate the burner tip angles employed to generate the above-noted gas streams. In particular, angles $\alpha$ and $\beta$ dictate the resulting direction of the gas stream emitted therefrom. Angle $\alpha$0 is the angle between the horizontal plane of the incinerator and the orifice axis x, which dictates the direction of the gas stream. As noted above, the burner assembly includes burners where angle $\alpha$ is somewhere between horizontal and vertical.

Angle $\beta$, shown in FIG. 4, is measured between the radius of the incinerator and the orifice axis and, as noted above, the angle $\beta$ between the radius of the cylindrical incinerator and the orifice axis is between radial and tangential, and in one embodiment closer to tangential than radial.

These angles together define the orientation of the HP burner and specifically, the axis x of the orifice outlet, which dictates the direction along which gas is emitting from the burner. Duplicating the burner orientations through all of the plurality of burners symmetrically positioned on a circular manifold results in an injection of fuel gas and a resulting exhaust that moves substantially uniformly helically, which may also be described as spirally, upward before exiting the cylindrical incinerator stack.

The optimum positioning of the burners is as follows:

(a) The angle $\alpha$ is selected within a range from 30° to 55°, or possibly 35 to 50° above an orthogonal plane through the incinerator, as is shown in FIG. 3; and (b) The angle $\beta$ was selected within a range between 45° and 70° degrees from a radial line radiating out from the centre axis of the cylindrical incinerator and the orifice axis, as shown in FIG. 4.

Figure 5:
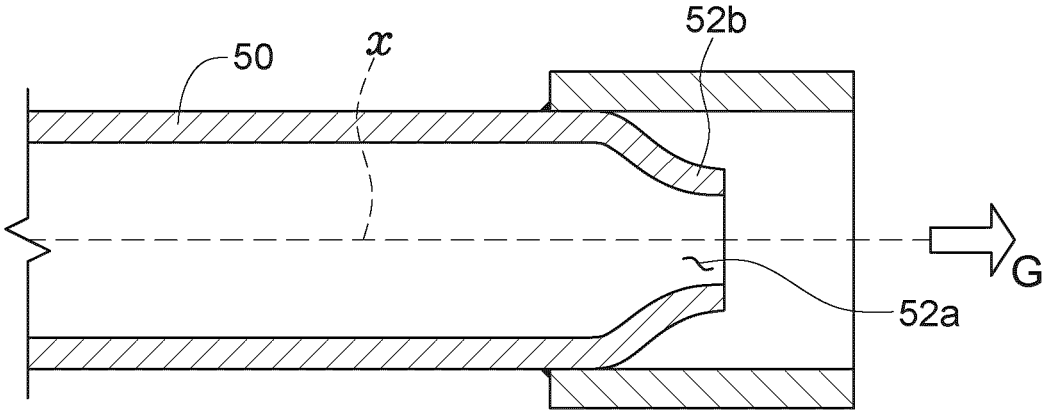
FIG. 5: A section along the long axis x of an HP burner.

Each burner may be equipped with an orifice outlet 52*b* for example defined as a nozzle as shown in FIG. 5, that causes a restriction in the orifice at the outlet, which is at the burner tip. With this restriction and considering the gas pressure, the gas exiting the burner can be selected to be within a velocity range to produce a desired thrust or "jetting" of the gas upwards into the combustion zone.

The velocity of the gas exiting the burner may influence the mixing, the burners can be equipped with a broad range of orifice sizes. Desired conditions of gas to be flowed through the burners may influence the selection of the orifice restriction size.

It is known that a smaller orifice restriction will entrain more surrounding air than a larger orifice restriction, at a given distance from the burner tip. Therefore, while it is the burner orientation that optimizes the operation of the incinerator, a suitable orifice restriction diameter (i.e. nozzle diameter) may be selected to accommodate and utilize the pressure and flow rate of the gas.

The burner velocity, controlled by selection of orifice restriction diameter, in one embodiment is selected to be within Mach 0.3 and Mach 1.0.

The incinerator with HP burners generates excellent air induction. In some situations a site may include more than one source of fluid to be incinerated. For example, some sites have high pressure and low pressure fluid sources to be combusted, where a high pressure gas source has pressure greater than 4 psi and usually greater than or equal to 5 psi, and a lower pressure gas source has pressure less than 5 psi and, often, much less than 5 psi.

In one embodiment, therefore, the incinerator may include a dependent low pressure (DLP) burner assembly. Because the HP burners generate significant induction, they may be used to draw low pressure gas—even where the low pressure gas does not have sufficient pressure to adequately flow on its own.

Figure 7A:
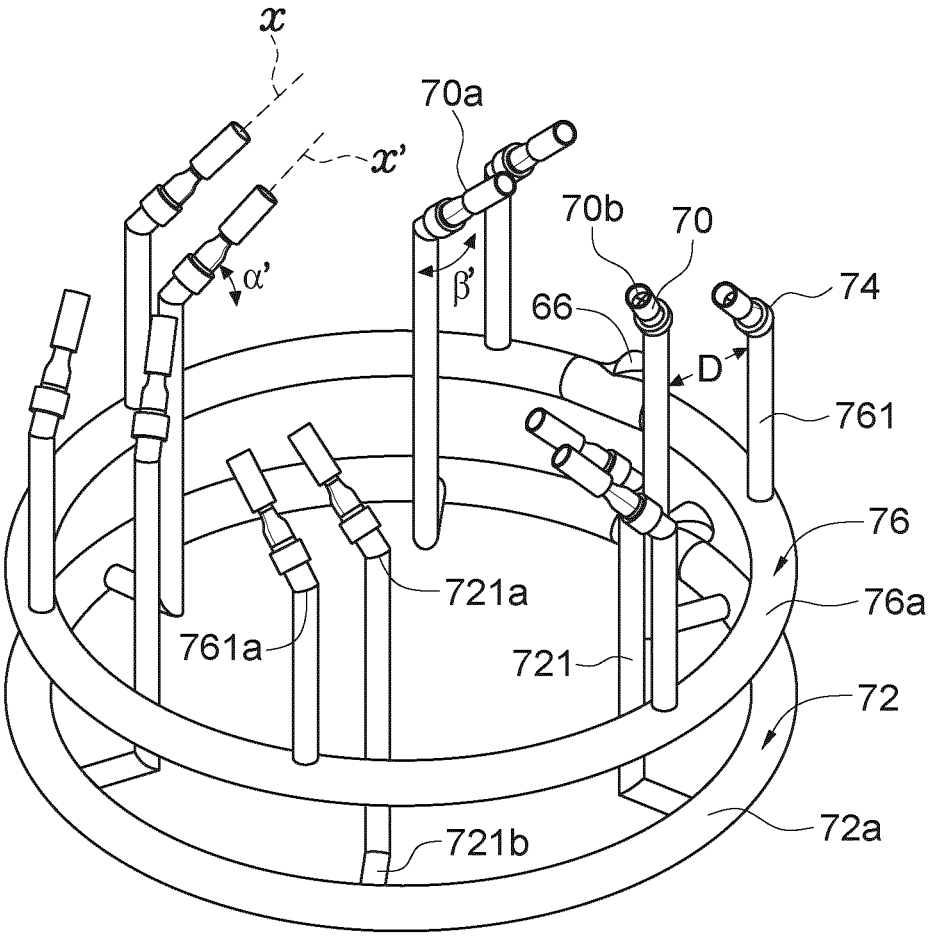
FIG. 7A: Oblique view of a burner arrangement with a combination of HP burners and dependent low pressure (DLP) burners for handling two gas sources.

A DLP burner works in conjunction with the HP burner described above, allowing a single incinerator to accept two waste streams: one at high pressure, and one at low pressure. FIG. 7A illustrates HP burners 74 installed on a first ring-shaped manifold 76, and DLP burners 70 installed on a second ring-shaped manifold 72. Both manifolds may be installed within the incinerator wall to avoid problems with freeze up. Thus, the circular pipes forming the manifolds may be entirely within the incinerator wall. Two supply pipes (i.e. one for high pressure gas and one for low pressure gas supply) penetrate the incinerator wall to convey gas to the manifolds.

Operation of DLP burners 70 relies on the operation of HP burners 74, so the operation of any DLP burner requires that there be at least one HP burner in the incinerator. In one embodiment, there may be an equal number of HP burners 74 and DLP burners 70. Each HP burner may be paired with, for example positioned nearby, a DLP burner. As with the HP burners, the DLP burners may therefore be substantially evenly spaced about their manifold 72, such that the manifold and the position of its DLP burners are substantially symmetrical.

Each DLP burner 70 includes a body 70*a* and an orifice therein through which gas moves through the DLP burner. Each orifice has an orifice outlet 70*b* at an outboard end or tip where the gas is emitted as a stream. The stream of gas emitted from the DLP burner is along a line aligned with the long axis of the orifice at the outlet. In one embodiment, a DLP burner is used that has an orifice outlet with a long axis concentric to the DLP burner's elongate body and the outlet of the orifice is at an outboard tip of the body. In other words, each DLP burner has a body that is elongate with a length and a long axis passing through the DLP burner tip. The gas orifice of each body extends along at least a portion of the length of the body and has an outlet at the tip of the body, which extends along an orifice axis x, which in one embodiment is parallel to, or substantially coincident with, the long axis of the DLP burner. The stream of gas emitted by the DLP burner is inline with the orifice axis at the orifice outlet, which in this embodiment is inline with the long axis of the DLP burner body. Thus, the path of the emitted high pressure gas stream can be selected by appropriate positioning of the tip of each DLP burner.

The DLP burners may be substantially in the same axial location (i.e. height) as the HP burners along the long axis x of the incinerator so that the tips of all the burners open in substantially the same plane. A DLP burner may be positioned close to, for example, radially inward or outward from an HP burner. In the illustrated embodiment, the DLP burners are positioned radially inwardly from the HP burners. As such, the DLP burners are positioned more centrally in the incinerator inner diameter while the HP burners are around the outside closer to the incinerator inner wall and regularly spaced apart from each other. With this arrangement, the HP burners can act on a larger cross sectional area of the incinerator inner diameter and, for example, the greater induction result they can generate. Since the DLP burners are reliant on the HP burner-induced air flow in order to operate, enhanced operation can be achieved by positioning the DLP burners closer to the center of the incinerator, radially inward from the circle of HP burners.

A DLP burner may be positioned with its through-flow axis x' substantially parallel to that axis x of an adjacent HP burner. DLP burner body orientation and tip angles are employed to support and benefit from the above-noted gas streams. For example, the DLP burners are in the air flow induced by the jetted fuel and resulting combustion energy generated by the HP burners. The body of each DLP burner, therefore, may be oriented with its long axis aligned with the induced helical airflow, which means its smallest cross sectional area is orthogonal to the air flow. For example, each DLP has an orientation defined by angles $\alpha'$ and $\beta'$ that dictate long axis x' of the burner body and the resulting direction of the gas stream emitted therefrom.

As with the HP burner angle $\alpha$, angle $\alpha'$ is the angle between the horizontal plane of the incinerator and the DLP orifice axis x', which dictates the upward direction of the gas stream emitted therefrom. The DLP burner assembly includes DLP burners where angle $\alpha'$ is somewhere between horizontal and vertical.

Angle $\beta'$ is measured between the radius of the incinerator and the DLP orifice axis and the angle $\beta'$ is between radial and tangential, and in one embodiment closer to tangential than radial.

These angles together define the orientation of the DLP burner and specifically, the axis of the DLP orifice outlet, which dictates the direction along which gas stream flows from the DLP burner. Each DLP burner may have angles $\alpha'$ and $\beta'$ corresponding to (for example, substantially the same as angles $\alpha$ and $\beta$, respectively) of an adjacent HP burner.

A DLP burner tip may be separated from an HP burner tip by distance D. Distance D may be selected such that gas exiting the DLP burner tips may access the upward helical fluid flow created by the HP burners, described above. The DLP burner tips may be in fluid communication with the fluid flow created by the HP burners. This fluid flow induces air through the DLP burner; that is, draws fluid from its source, through the manifold and out of the DLP burner. This allows greater combustion of gas, thereby improving the efficiency of the incinerator.

Distance D may be selected to avoid flame impingement of the HP burner tips. That is, an HP burner and a DLP burner may be separated by distance D to avoid having the HP burner's flame impinge on the DLP burner.

Figure 7B:
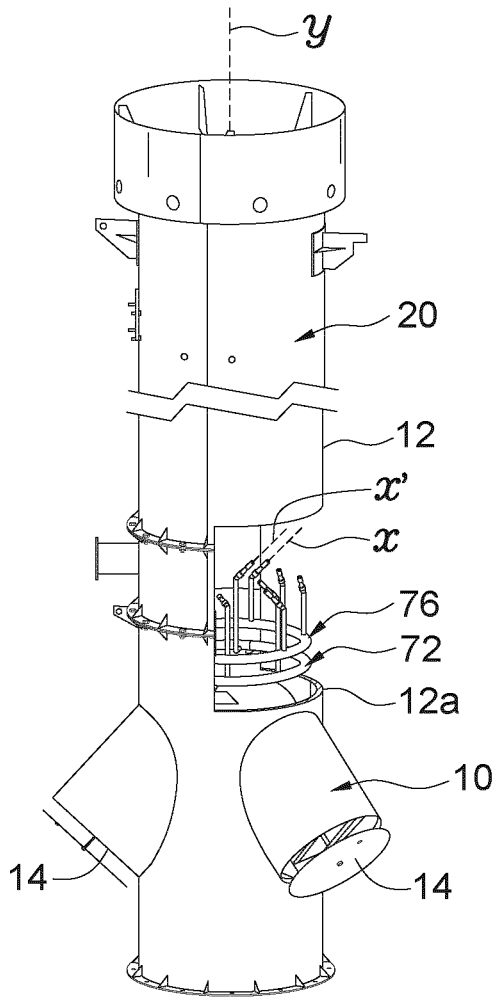
FIG. 7B: Components of another incinerator according to one possible embodiment of the invention, wherein a side is cut away to facilitate illustration of internal components.

The DLP manifold 72 and the HP manifold 76 may be vertically aligned one above the other to avoid excessively occluding the cross sectional space inside the incinerator wall. For example, the DLP manifold may have substantially the same diameter and may be positioned below and centered on the same center axis as the HP manifold 76, as illustrated in FIGS. 7A and 7B.

As noted, the HP manifold may have an upwardly extending conduit 761 for connection to each HP burner 74. An upper end of the HP manifold's upwardly extending conduit may have a bend 761*a* selected to allow the HP burner to be oriented according to angles $\alpha$ and $\beta$. In other words, the upper end of the HP manifold's conduit may extend (i) at an upward angle greater than horizontal and less than vertical and (ii) at a radially inwardly directed angle between a tangential and a radially inward direction.

There may be upwardly extending conduits 721 coupled between the manifold ring portion 76*a* and the burners 70. In particular, there may be an upwardly extending conduit 721 for support and positioning of each DLP burner 70. An upper end of the DLP conduit may have a bend 721*a* selected to allow the DLP burner to be oriented according to angles $\alpha'$ and $\beta'$. In other words, the upper end of each DLP manifold's conduit may extend (i) at an upward angle greater than horizontal and less than vertical and (ii) between a tangential and a radially inward direction. Bends 761*a* and 721*a* may be in substantially the same axial location along the long axis of the incinerator.

The DLP conduits may have an inwardly extending conduit portion 721*b* for connection between manifold ring portion 72*a* and the upwardly extending portion of conduit 721. That is, upwardly extending conduit 721 and inwardly extending conduit portion 721*b* may meet at an elbow, such as at a substantially right angle. Inwardly extending conduit 721*b* allows its DLP burner to be positioned radially inward from an adjacent HP burner. Inwardly extending conduit portion 721*b* is sized to position DLP burner near and at distance D from an HP burner, with the DLP burner radially inwardly from the HP burner. The upwardly extending portions of conduits 721 position the DLP burner tips in substantially the same axial location (i.e. height) along the long axis of the incinerator as the HP burner tips.

The various components of HP manifold 76 may be integral or coupled, including ring portion 76*a*, upwardly extending conduit 761, and bend 761*a*. The various components of DLP manifold 72 may be integral or coupled, including ring portion 72*a*, upwardly extending conduit 721, bend 762*a*, and inwardly extending conduit 721*b*.

The following examples are included to illustrate function, of example embodiments.

Example I

Tests were conducted to study a burner for a high pressure gas sources. In the tests, gas at a pressure of about 5 psi (34.5 kPa), as measured by gauge, was injected to a burner assembly with six burners on a circular manifold in a cylindrical stack, as shown in FIG. 1.

Data was collected from the following:

Initial burner tip orientation—Data was obtained from a burner orientation where:

(a) The angle β was selected at 45 degrees from the radius of the cylindrical incinerator and intersecting the burner tip axis.

(b) The angle α was selected at 30 degrees above the horizontal plane.

Final burner tip orientation—Data was obtained from a range of burner orientations where:

(a) The angle β was varied within the range between 45 and 70°.

(b) The angle α was varied within the range from 35 to 50° above a horizontal plane.

Figure 6:
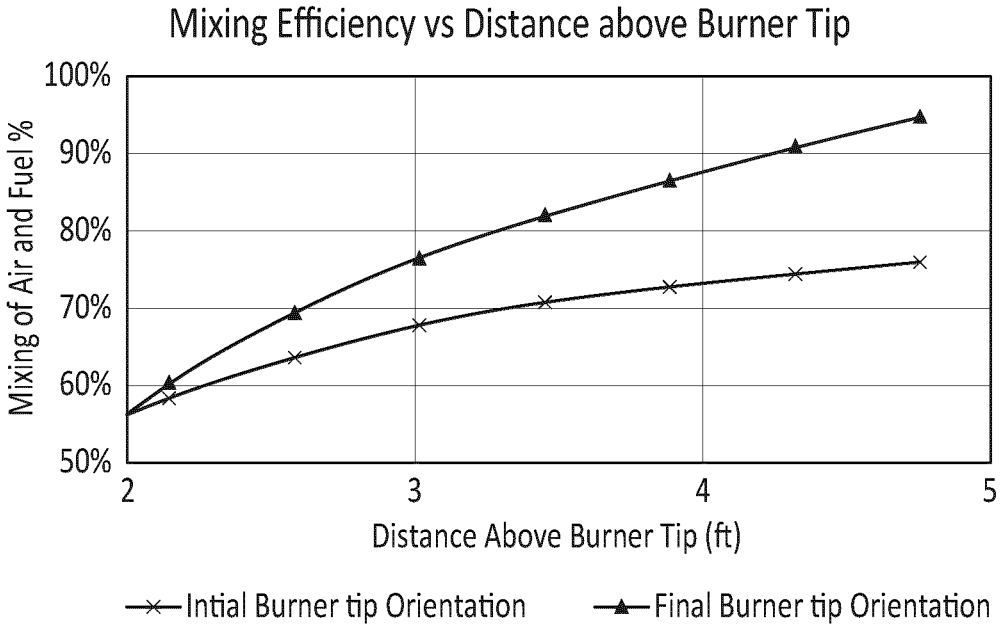
FIG. 6: A graph showing mixing efficiency with burner tip orientation.

While both orientations are according to a new burner configuration described herein, the two orientations were selected for study to determine if even greater control over the burner tip orientation would generate an improved result. FIG. 6 illustrates the mixing efficiencies for the Initial burner tip orientation as against averaged results for the Final burner tip orientation.

With mixing being one of the parameters, the burners were initially oriented in a position to promote a helical upwards pattern, simply as a starting point. Mixing efficiency measures the extent that air and waste gas are able to blend together above the burner tips in the combustion zone. This parameter was selected as a prime objective as, the more homogenous the mixture the higher the combustion efficiency, also known as oxidation, of hydrocarbons. With high mixing the hydrocarbon has the best accessibility to any available oxygen.

Example II

A Q500™ incinerator from Questor Technologies Inc. was fitted with a manifold as shown in FIG. 2. The burners were oriented with angle β of 70° and then air flow was determined with the angle α set at 20°, 30°, 35°, 50° and 55° degrees. The results are shown in Table I.

TABLE I

Air Flow into incinerator with reference to burner angle α.

| Burner Angle α | Air Flow (×1000 $ft^3$/day) |
|---|---|
| 20° | 3200 |
| 30° | 10300 |
| 35° | 14900 |
| 50° | 18000 |
| 55° | 12300 |

In order to operate an incinerator as a natural draft system (i.e. not forcing air in through a driven air mover, such as with a blower), it is important to draw in air to the greatest extent possible with the means that are available. Air flow was found to be improved by orienting the burners.

It was found that the desired objectives of high mixing, no flame impingement on the incinerator wall and high negative pressure below the burners were achieved with the final burner tip orientation. As the burner tip orientations were altered, both mixing and negative pressure were measured to find optimum positioning. At the final burner tip orientation, mixing improved even over the original orientation, as in FIG. 6. The tip position influenced air flow as shown in Table I.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. An incinerator comprising:

a cylindrical housing extending generally vertically and defining an air intake section, a combustion section above the air intake section, a stack section above the combustion section, a center axis defined as extending through the air intake section and the stack section and a horizontal plane orthogonal to the center axis; and a burner assembly in the combustion section, the burner assembly including a manifold with a plurality of conduits extending substantially vertically therefrom to a burner outlet at a distal end thereof, wherein each of the burner outlets are located at a common horizontal plane across the cylindrical housing, and wherein each of the burner outlets are radially arranged about the central axis and oriented to emit gas (i) at an upward angle greater than horizontal and less than vertical from an orthogonal plane of the incinerator and (ii) between a tangential and radially inward direction from an radius of the cylindrical housing, such that the plurality of burners in the burner assembly collectively generate an upward, helical gas flow.

2. The incinerator of claim 1 wherein the gas is emitted upwardly from the burners away from the horizontal plane towards the stack section at an angle of between 30° and 55° from an orthogonal plane of the incinerator.

3. The incinerator of claim 1 wherein the gas is emitted sideways at an angle of between 45° and 70° from a radius of the cylindrical housing.

4. The incinerator of claim 3 wherein the plurality of burners are positioned spaced apart in a circle about the center axis and each of the burners are angled sideways in the same clockwise or counterclockwise direction.

5. The incinerator of claim 1 wherein the gas is emitted upwardly from the burners away from the horizontal plane towards the stack section at an angle of between 30° and 55° from an orthogonal plane of the incinerator; and the gas is emitted sideways at an angle of between 45° and 70° from a radius of the cylindrical housing.

6. The incinerator of claim 1, wherein each conduit includes a bend causing the burner to be oriented to emit gas at the upward angle and in the tangential and radially inward direction.

7. The incinerator of claim 1, further comprising a dependent burner assembly in the combustion section, the dependent burner assembly including a plurality of dependent burners, each of the dependent burners configured to receive and deliver a low-pressure gas stream.

8. The incinerator of claim 7, wherein each of the plurality of dependent burners is oriented to emit gas at the upward angle and in the same direction as the burner.

9. The incinerator of claim 7, wherein each dependent burner is positioned radially inward from one of the burners.

10. The incinerator of claim 7, wherein the dependent burner assembly further comprises a second manifold within the cylindrical housing, the plurality of dependent burners being connected to the second manifold.

11. The incinerator of claim 10, wherein the manifold and the second manifold are vertically aligned.

12. An incinerator comprising:

a cylindrical housing extending generally vertically and defining an air intake section, a combustion section above the air intake section, a stack section above the combustion section, a center axis defined as extending through the air intake section and the stack section and a horizontal plane orthogonal to the center axis;

a first burner assembly in the combustion section, the first burner assembly including a plurality of first burners on a first manifold connected to a first intake pipe, wherein each of the plurality of first burners has a gas emitting orifice with an axis oriented (i) at an upward angle of between 30° and 55° from an orthogonal plane of the incinerator and (ii) at a sideways angle of between 45° and 70° from a radius of the cylindrical housing, such that the plurality of first burners in the first burner assembly collectively generate an upward, helical gas flow; and a dependent burner assembly in the combustion section, the dependent burner assembly including a plurality of dependent burners on a second manifold connected to a second intake pipe, the plurality of dependent burners being positioned radially inward of the plurality of first burners and the plurality of dependent burners being oriented to emit gas upwardly away from the horizontal plane towards the stack section at an angle of between 30° and 55° from an orthogonal plane of the incinerator; and sideways at an angle of between 45° and 70° from a radius of the cylindrical housing.

13. The incinerator of claim 12 wherein each of the first manifold and the second manifold have a circular shape and are positioned within the cylindrical housing and wherein the first manifold and the second manifold are vertically aligned.

14. The incinerator of claim 12 wherein the plurality of first burners are positioned spaced apart in a circle about the center axis and each of the first burners are angled sideways in the same clockwise or counterclockwise direction.

15. A method for incinerating gas comprising:

providing a cylindrical housing, and a first burner assembly and a dependent burner assembly within the cylindrical housing, the first burner assembly including a manifold with a plurality of conduits extending substantially vertically therefrom to a burner outlet at a distal end thereof wherein each of the burner outlets are located at a common horizontal plane across the cylindrical housing, and wherein each of the burner outlets are radially arranged about the central axis and oriented at an upward angle from an orthogonal plane of the cylindrical housing and at a sideways angle from a radius of the cylindrical housing; and flowing gas through the first burner assembly, thereby generating an upward, helical gas flow within the cylindrical housing, and drawing a gas flow through the dependent burner assembly.

16. The method of claim 15, wherein the cylindrical housing extends generally vertically and defines an air intake section, a combustion section above the air intake section, a stack section above the combustion section, the center axis defined as extending through the air intake section, the stack section, and the horizontal plane;

the first burner assembly is in the combustion section, the first burner assembly including the first burner is on a first manifold connected to a first intake pipe, the first burner has a gas emitting orifice with an axis oriented (i) at the upward angle, the upward angle being between 30° and 55° from the orthogonal plane of the cylindrical housing and (ii) at the sideways angle, the sideways angle being between 45° and 70° from the radius of the cylindrical housing, such that the first burner generates the upward, helical gas flow; and the dependent burner assembly is in the combustion section, the dependent burner assembly including a dependent burner on a second manifold connected to a second intake pipe, the dependent burner being positioned radially inward of the first burner and the dependent burner being oriented to emit gas upwardly away from the horizontal plane towards the stack section at an angle of between 30° and from the orthogonal plane; and sideways at an angle of between 45° and 70° from the radius.

* * * * *